US010311664B2

(12) United States Patent
Baumgarte et al.

(10) Patent No.: US 10,311,664 B2
(45) **Date of Patent: *Jun. 4, 2019**

(54) MULTIFUNCTIONAL ACCESS CONTROL DEVICE

(71) Applicant: Schlage Lock Company LLC, Carmel, IN (US)

(72) Inventors: Joseph W. Baumgarte, Carmel, IN (US); Todd Eberwine, Golden, CO (US); Frank Kasper, Carmel, IN (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/141,409

(22) Filed: Sep. 25, 2018

(65) Prior Publication Data

US 2019/0043296 A1 Feb. 7, 2019

Related U.S. Application Data

(63) Continuation of application No. 15/786,103, filed on Oct. 17, 2017, now Pat. No. 10,083,560, which is a continuation of application No. 14/886,853, filed on Oct. 19, 2015, now Pat. No. 9,792,747.

(60) Provisional application No. 62/183,091, filed on Jun. 22, 2015.

(51) Int. Cl.
*G07C 9/00* (2006.01)

(52) U.S. Cl.
CPC ..... *G07C 9/00817* (2013.01); *G07C 9/00309* (2013.01); *G07C 9/00563* (2013.01); *G07C 9/00571* (2013.01); *G07C 2009/00825* (2013.01); *G07C 2009/00841* (2013.01)

(58) Field of Classification Search
CPC ..... G07C 9/00817; G07C 9/00309; G07C 9/00174; G07C 2009/00825; G07C 2009/00841
See application file for complete search history.

(56) References Cited

U.S. PATENT DOCUMENTS

| | | | | |
|---|---|---|---|---|
| 8,689,294 | B1 * | 4/2014 | Thakur | H04L 63/08 713/182 |
| 9,390,572 | B2 * | 7/2016 | Almomani | G07C 9/00309 |
| 9,406,181 | B2 * | 8/2016 | Almomani | G07C 9/00309 |
| 10,083,560 | B2 * | 9/2018 | Baumgarte | G07C 9/00817 |
| 2011/0285528 | A1 * | 11/2011 | Weinstein | E05B 19/22 340/539.11 |
| 2012/0119877 | A1 * | 5/2012 | Ng | E05B 19/0005 340/5.61 |

(Continued)

*Primary Examiner* — Thomas D Alunkal
(74) *Attorney, Agent, or Firm* — Taft Stettinius & Hollister LLP

(57) ABSTRACT

An access control device that at least assists in controlling the ingress/egress through an entryway. According to certain embodiments, the access control device is operably coupled to an entryway device so as to at least assist in controlling the ability to displace an entryway device from a closed position and/or from an open position. The access control device is structured for communication with a plurality of components of a security management system, and thus may be programmed by one or more modes, including, for example a manual program mode, an off-line managed mode, a wireless off-line management mode, a wireless real-time mode, and/or an off-line real-time mode.

21 Claims, 2 Drawing Sheets

(56) References Cited

U.S. PATENT DOCUMENTS

| | | | | |
|---|---|---|---|---|
| 2012/0129451 | A1* | 5/2012 | Metivier | H04L 63/061 455/41.1 |
| 2012/0280783 | A1* | 11/2012 | Gerhardt | G07C 9/00309 340/5.6 |
| 2013/0297075 | A1* | 11/2013 | Land, III | G05B 15/02 700/275 |
| 2014/0002236 | A1* | 1/2014 | Pineau | G06F 21/32 340/5.6 |
| 2014/0028438 | A1* | 1/2014 | Kuenzi | G07C 9/00817 340/5.24 |
| 2014/0120905 | A1* | 5/2014 | Kim | H04W 12/06 455/426.1 |
| 2014/0340195 | A1* | 11/2014 | Polak | G07C 9/00571 340/5.61 |

* cited by examiner

MULTIFUNCTIONAL ACCESS CONTROL DEVICE

CROSS REFERENCE TO RELATED APPLICATIONS

The present application is a continuation of U.S. patent application Ser. No. 15/786,103, filed on Oct. 17, 2017 and issued as U.S. Pat. No. 10,083,560, which is a continuation of U.S. patent application Ser. No. 14/886,853, filed on Oct. 19, 2015 and issued as U.S. Pat. No. 9,792,747, which claims the benefit of U.S. Provisional Patent Application Ser. No. 62/183,091, filed Jun. 22, 2015, the contents of each application are hereby incorporated by reference in their entirety.

BACKGROUND

Embodiments of the present invention generally relate to multifunctional access control devices. More particularly, but not exclusively, embodiments of the present invention relate to access control devices that are adaptable to being configured to be programmed using a plurality of modes of electronic communication.

Security management systems often utilized a variety of access control devices to control ingress and/or egress through an entryway. The operation and management of such security management systems typically involves the transmission and/or receipt of certain electronic communications to, as well as between, different access control devices. For example, verification of authorization to unlock an electronic lock device may involve electronic communications being received or retrieved by access control devices from other devices or components of the security management system. Depending on how a particular access control device operates, the security management system may utilize several different devices or components of the security management system that are not part of that access control device in the performance of a function by the access control device, including, for example, other access control devices, an access control panel, and/or wiring, among other devices. Further, in certain situations, the operation and management of a particular access control device may involve electronic communications from several different types of integrated access control devices. However, different components of the security management system may communicate using different communication modes, including, for example, different communication protocols. Accordingly, limitations in the types of communication modes in which an access control device may receive, or retrieve, and/or transmit, information may limit the devices that can communicate, or the manner in which the devices can communicate, with the access control device, and thereby limit which security management systems may use the access control device.

BRIEF SUMMARY

An aspect of an embodiment of the present invention is an access control device for controlling the displacement of an entryway device. The access control device includes a plurality of wireless transceivers and a memory for storing instructions, at least a portion of the instructions relating to the displacement of the entryway device. The access control device further includes a processing device that is coupled to the memory. The processing device is adapted to select from three or more of the following programming modes for programming of the access control device: (a) a manual program mode, (b) an off-line managed mode, (c) a wireless off-line management mode, (d) a wireless real-time mode, and/or (e) off-line real-time mode.

Another aspect of an embodiment of the present invention is an electronic lock device that includes a lock mechanism, at least a portion of the lock mechanism being selectively displaceable between a locked position and an unlocked position. The electronic lock device also include an input/output device that is adapted to receive instructions from two or more external devices for execution by a processing device of the electronic lock device in three or more of the following programming modes: (a) a manual program mode, (b) an off-line managed mode, (c) a wireless off-line management mode, (d) a wireless real-time mode, and/or (e) off-line real-time mode.

Additionally, an aspect of an embodiment of the present invention is an access control device that includes a credential reading interface structured to read at least one type of credential. The access control device also include an input/output device that is adapted to receive instructions from two or more external devices for execution by a processing device of the access control device in three or more of the following programming modes: (a) a manual program mode, (b) an off-line managed mode, (c) a wireless off-line management mode, (d) a wireless real-time mode, and/or (e) off-line real-time mode.

BRIEF DESCRIPTION OF THE DRAWINGS

The description herein makes reference to the accompanying figures wherein like reference numerals refer to like parts throughout the several views.

Figure 1A:
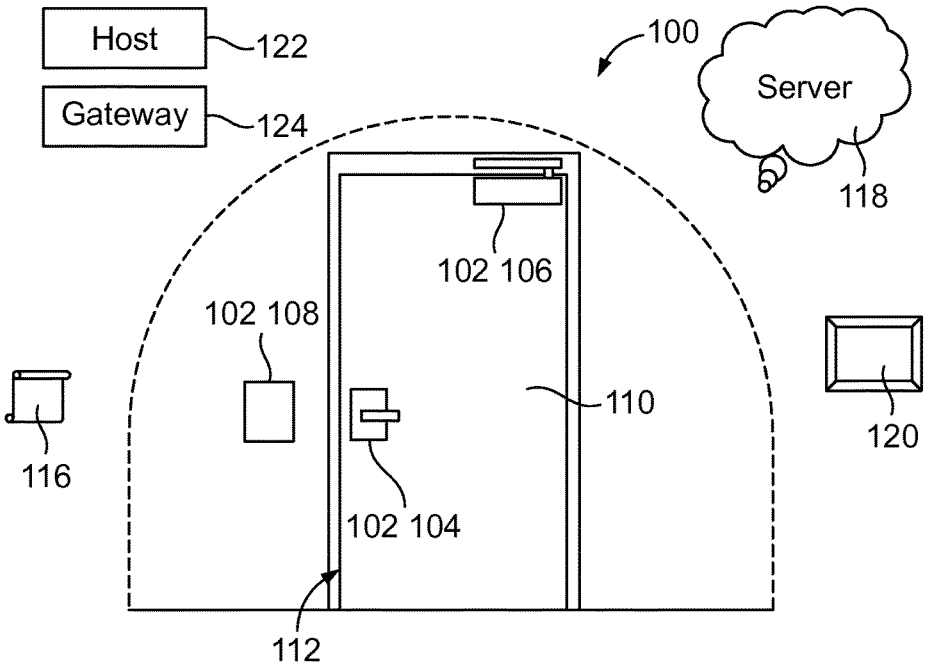
FIG. 1A illustrates a schematic view of an exemplary security management system.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DESCRIPTION OF THE ILLUSTRATED EMBODIMENTS

Certain terminology is used in the foregoing description for convenience and is not intended to be limiting. Words such as "upper," "lower," "top," "bottom," "first," and "second" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

FIG. 1A illustrates a schematic view of an exemplary security management system 100. As illustrated, the security management system 100 includes a plurality of access control devices 102, which in this example can include one or more lockset devices 104, door closers 106, and reader devices 108, and/or a combination thereof. However, the number and types of access control devices 102 may vary for different security management systems 100. For example, according to certain embodiments, the security management system 100 can also include, in addition to or in lieu of other access control devices 102, one or more exit devices and/or payment terminals, among other access control devices 102.

At least some types of access control devices 102 may be involved with controlling, managing, and/or facilitating the displacement, including authorization to displace, an entryway device 110 from closed position to an open position, and/or from an open position to a closed position, and thereby at least assist in controlling ingress/egress through the associated entryway(s) 112. For example, according to certain embodiments, at least one access control device 102 may be a lockset device 104, such as, but not limited to, an electronic lock device, that includes a lock mechanism 114 that may include, for, example, a displaceable bolt and/or a latch, that is displaceable between locked and unlocked position to selectively lockingly engage the adjacent door frame, wall, and/or mating components that are coupled or mounted to/in the adjacent door frame and/or wall. Similarly, according to other embodiments, the access control devices 102 may include of an exit device having a push bar or push pad that is coupled to a lock mechanism that includes a latch assembly. According to such an embodiment, the operable displacement of the push bar or pad can facilitate the displacement of a latch of the latch assembly from an extended, locked position to a retracted, unlocked position.

The door closer 106 can be configured to at least provide a force that assists in the displacement of the entryway device 110. For example, the door closer 106 may provide a force that at least assists the displacement of the entryway device 110 from an open position to the closed position. Thus, certain door closers 106 may be structured to automatically return an opened, or partially opened, entryway device 110 to the closed position, and thereby remove the need for manual closing by a user. Conversely, according to certain embodiments, the door closer 106 may be set to resist the displacement of the entryway device 110 from at least one of the open and closed positions by a user.

The reader device 108 may receive or detect identification information in connection with a determination of whether displacement of the entryway device 110 and/or ingress/egress through the entryway 112 generally is, or is not, authorized. According to certain embodiments, the reader device 108 is a credential reader that retrieves or detects credential information on or from a credential device 116, such as, for example, a credential on a card or badge, among other credential devices 116. For example, certain reader devices 108 may include a credential reading interface structured to read at least one type of credential, including, but not limited to, a prox and/or NFC (i.e., smart card). However, the reader device 108 may receive identification information in a variety of other manners, including, for example, through the use of a fingerprint or retinal scan, keypad entry, and/or wireless communication. The identification information provided to, or retrieved by, the reader device 108 may be evaluated by the reader device 108 or another device of the security management system 100 in connection with determining whether the credential and/or associated user has permission or authorization to operate components of the security management system 100, such as, for example, to unlock the lock mechanism 114 of an associated access control device 102 and/or to displace the entryway device 110.

The security management system 100 may also include a server 118 that may comprise one or more servers that may communicate with one or more of the access control devices 102 in a variety of different manners, including, for example, over a wide area network (WAN) (e.g. the Internet), a cellular data network, a local area network (LAN), or any combination thereof. According to certain embodiments, the server 118 may include, or comprise, a cloud-based server. However, a variety of other different types of servers may also be used for the server 118, including, for example, a web-based server. Further, according to certain embodiments, different servers 118 may be used for different purposes, such as, for example, a cloud-based server for installation, maintenance, and/or management of, or relating to, the security management system 100, the reader device 108, and/or the credential device 116, and another, different server, such as, for example, a web-based server, may be used for other purposes, such as, for example, general, day-to-day usage and/or operation of one or more of the access control devices 102.

The server 118 may be configured to store a variety of different information, including, for example, user lists, access logs, and information related to each credential device 116, such as, for example, access permissions for each credential device 116 corresponding to each user in the user lists, a location, status, and/or type identifiers for each credential device 116 and/or reader device 108, and/or any other information for the system 100. As discussed below, according to certain embodiments, a portion of such information stored by the server(s) 118 may be received or retrieved by one or more of the access control devices 102 in connection with the programming the access control device 102, including, for example, programming, updating, or operation of the access control devices 102. The server 118 may further include non-transitory computer executable instructions to perform various operations in the form of an application. The various operations may include, but are not limited to, functionality to program one or more of the access control devices 102, verify access permissions received from the credential devices 116 at each reader device 108, determine a communication protocol or mode that is to be used to communicate information to devices of the security management system 100, issue commands for the access control device 102 to establish a direct or indirect connection to the server 118, and updating the server 118 user lists, access permissions, adding and/or removing reader devices 108 for/from the system 100, among other operations.

The security management system 100 may also include one or more mobile or portable electronic devices 120 such as, for example, personal electronic devices, including, but not limited to, a smartphone and a tablet computer, and the like. The mobile electronic device 120 may be in communication with one or more of the access control devices 102 in a variety of different manners, including, for example, via a wireless communication protocol such as WI-FI and/or Bluetooth Low Energy (BLE). The access control device 102 may send to the mobile electronic device 120 a variety of different types of information, such as, for example, device identification information, diagnostic results, usage data, and the like, among other types of information. Additionally, according to certain embodiments, the mobile electronic device 120 may communicate with the server 118. For example, the mobile electronic device 120 may send a variety of different types of information to the server 118, such as, for example, identification information relating to the owner of the mobile electronic device 120, information identifying the access control device(s) 102 to which the mobile electronic device 120 is communicating, or attempting to communicate, with, firmware updates, information regarding activation or deactivation of components or access control devices 102, and/or information retrieved from the access control device 102, among other information.

The security management system 100 may also include a host 122 that is used to control and/or manage the operations of the security management system 100. The host 122 may include any type of computing device, such as, for example, a laptop or desktop computer, or a mobile electronic device, among other computing devices, that includes a memory and a processor sufficient in size and operation to store and manipulate a database and one or more applications for communicating with the other devices of the security management system 100, as illustrated, for example, in FIG. 1B. For example, according to certain uses, a company, facility, or entity may utilize the host 122 to manage and oversee the operations of the security management system 100, including, for example, establishing authorization of certain credentials and/or users, establishing times for access control devices 102 to seek updates, setting parameters regarding time periods during which entryway devices 110 may be displaced from their respective closed position, and/or monitoring and analyzing information pertaining to the usage of components of the security management system 100.

According to certain embodiments, the security management system 100 may include a gateway 124 that may be used to establish communications between the host 122 and one or more of the access control devices 102. According to the illustrated embodiment, the host 122 is a WAN/LAN-based host that communicates with the gateway 124 via an Ethernet WAN/LAN connection. Additionally, the gateway 124 can communicate with one or more access control devices 102 using one or more wireless protocols. For example, according to the exemplary embodiment shown in FIGS. 1A and 1B, the gateway 124 includes multiple transceivers that can communicate with one or more access control devices 102 using two or more wireless protocols, including, but not limited to, WI-FI, Bluetooth (including Bluetooth low energy (BLE)), Zigbee, Near Field Communication (NFC), and/or IEEE 802.15. Thus, according to certain embodiments, the gateway 124 may include at least a first transceiver 126*a* that communicates with one or more access control devices 102 via a first wireless protocol, and a second transceiver 126*b* that communicates with the one or more access control devices 102 via a second wireless protocol, the first wireless protocol being a different type of wireless protocol than the second wireless protocol. Thus, for example, according to certain embodiments, the first transceiver 126*a* may be a low energy Bluetooth (BLE) transceiver, while the second transceiver 126*b* is a WI-FI transceiver. The first and/or second transceivers 126*a*, 126*b*, and thus the associated wireless communication protocol, selected for a particular communication with the access control device(s) 102 may depend on a variety of factors. For example, in at least certain situations, communications that may involve the transfer of a relatively large amount of data, such as, for example firmware updates, may be transmitted using the transceiver 126*a*, 126*b* that uses the wireless protocol that provides additional or larger bandwidth. Accordingly, in the illustrated example, communications that may involve a relatively large amount of data may be transmitted via the second, WI-FI transceiver 126*b* rather than the first, BLE transceiver 126*a*, as the WI-FI connection, when compared to BLE, WI-FI may provide additional bandwidth. Another consideration, among others, in the selection of wireless protocol to use for a communication by may be the amount of energy or power that will be used in the connection and/or communication, particularly for access control devices 102 that are powered by a battery. More specifically, according to the illustrated example, in situations in which differences in available bandwidth may be less significant, the first, BLE transceiver 126*a*, which can have lower anticipated power consumption than a WI-FI connection and/or communication, may be utilized for the connection and/or communication between the gateway 124 and the access control device 102.

The circuitry in the various devices of the security management system 100 may also be configured to provide appropriate signal conditioning to transmit and receive desired information (data) from other devices used in or by the system 100. Thus, for example, devices of the security management system 100 can include filters, amplifiers, limiters, modulators, demodulators, CODECs, digital signal processing, and/or different circuitry or functional components, among other components, that may facilitate the transmission and/or receipt of such communications.

Figure 2:
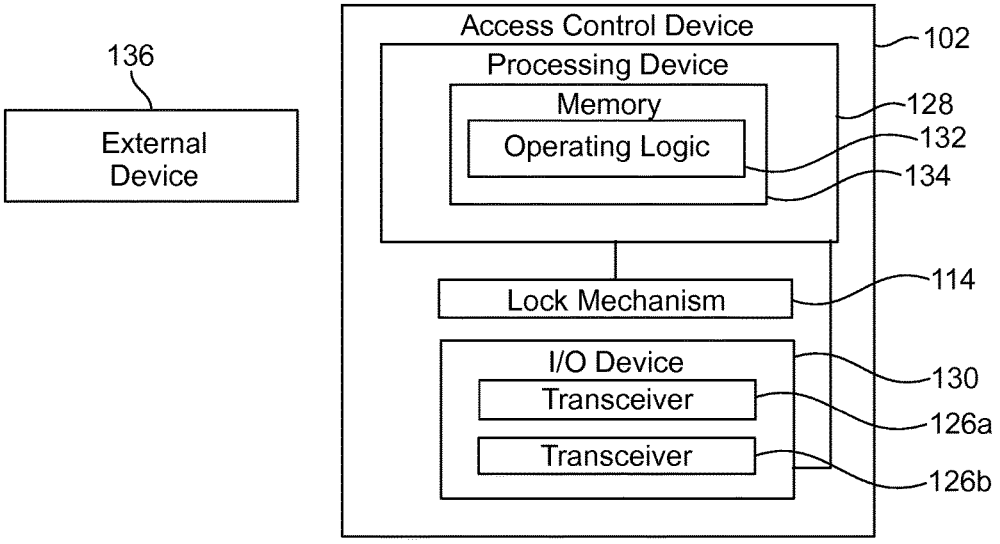
FIG. 2 illustrates a schematic of an exemplary access control device.

FIG. 2 illustrates a schematic of an exemplary access control device 102. As illustrated, the access control device 102 can include a processing device 128, an input/output device 130, operating logic 132, and a memory 134 that may or may not be part of the processing device 128. The input/output device 130 allows the access control device 102 to communicate with one or more external devices 134, which may be any type of device that allows data to be inputted or outputted from the access control device 102. For example, according to certain embodiments, the external device 136 may include a server 118, host 122, or mobile electronic device 120, and/or other access control devices 102 of the security management system 100. Additionally, according to certain embodiments, the external device 136 may be a switch, a router, a firewall, a server, a database, a networking device, a controller, a computer, a processing system, a printer, a display, an alarm, an illuminated indicator such as a status indicator, a keyboard, a mouse, or a touch screen display. Additionally, according to certain embodiments, the external device 136 may be integrated into the access control device 102. It is further contemplated that there may be more than one external device 102 in communication with the access control device 102.

Figure 1B:
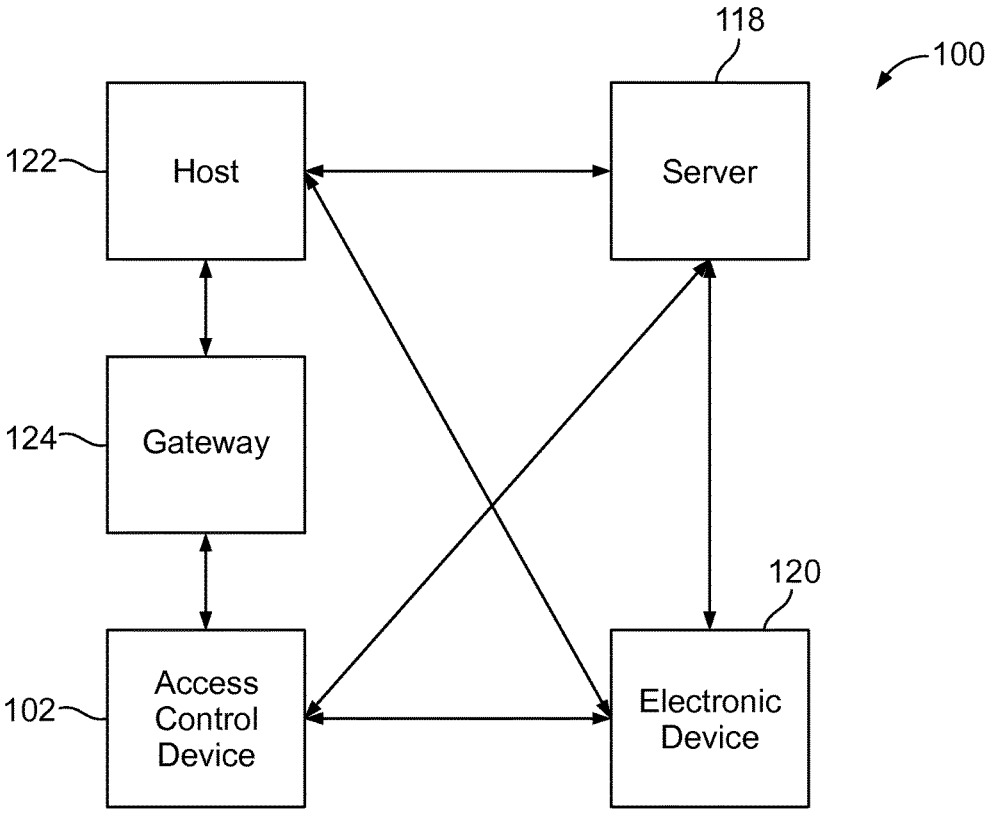
FIG. 1B illustrates a schematic representation of various possible connections between components of the exemplary security management system.

According to certain embodiments, the input/output device 130 includes one or more transceivers 126*a*, 126*b*, a network adapter, a network card, an interface, and/or a port, such as, for example, a USB port, serial port, parallel port, an analog port, a digital port, VGA, DVI, HDMI, FireWire, CAT 5, or any other type of port or interface. Further, the input/output device 130 may include hardware, software, and/or firmware. Additionally, it is contemplated that the input/output device 130 can include more than one of these adapters, cards, or ports. As shown in FIG. 2, according to certain embodiments, the input/output device 130 may include at least first and second transceivers 126*a*, 126*b* that are configured for communication with the host 122 using the previously discussed first and second wireless protocols. Additionally, as depicted in FIG. 1B, according to certain embodiments, the input/output device 130 may also be structured to communicate with a server 118, such as, for example, a cloud server, via an Internet Protocol (IP) connection over the Internet.

The processing device 128 of the access control device 102 can be a programmable type, a dedicated, hardwired state machine, or any combination of these. The processing device 128 may further include multiple processors, Arithmetic-Logic Units (ALUs), Central Processing Units (CPUs), Digital Signal Processors (DSPs), or the like. Processing devices 128 with multiple processing units may utilize distributed, pipelined, and/or parallel processing. The processing device 128 may be dedicated to performance of just the operations described herein or may be utilized in one or more additional applications. In the depicted form, processing device 128 is of a programmable variety that executes algorithms and processes data in accordance with operating logic 132 as defined by programming instructions (such as software or firmware) stored in memory 134. Alternatively, or additionally, the operating logic 132 for the processing device 128 is at least partially defined by hardwired logic or other hardware. The processing device 128 may include one or more components of any type suitable to process the signals received from input/output device 130 or elsewhere, and to provide desired output signals. Such components may include digital circuitry, analog circuitry, or a combination of both.

The memory 134 may be of one or more types, such as a solid-state variety, electromagnetic variety, optical variety, or a combination of these forms. Further, the memory 134 can be volatile, nonvolatile, or a combination of these types, and some or all of the memory 134 can be of a portable variety, such as a disk, tape, memory stick, cartridge, or the like. In addition, the memory 134 can store data that is manipulated by the operating logic 132 of the processing device 128, such as data representative of signals received from and/or sent to the input/output device 130 in addition to or in lieu of storing programming instructions defining the operating logic 132, just to name one example. As shown in FIG. 2, the memory 134 may be included with the processing device 128 and/or coupled to the processing device 128.

The access control device 102 is reconfigurable so that an administrator can configure or otherwise program the access control device 102 to operate in a plurality of modes of communication. More particularly, the access control device 102 may be adaptable to its environment, which can include its communication environment, such that the access control device 102 is able to be programmed, operated, and/or retrieve, receive, or communicate information in a variety of different modes or manners. In such situations, the adaptability of the access control device 102 to different modes of operation and/or communication may enhance the versatility of the access control device 102, and thereby allow, for example, the access control device 102 to be used in a variety of different types of security management systems, adjust to changes in the associated security management system 100, and/or increase the number and/or types of devices that the access control device 102 may communicate with, as well as accommodate for different modes of communication.

For example, according to the illustrated embodiment, the access control device 102 may be structured to be programmed in a first mode in which the access control device 102 is a manually programmed device. For example, in such situations, the access control device 102 can be manually programmed by a user or operator of the security management system 100. Similarly, each access control device 102 that is operating in the first mode may be manually, and separately or individually, programmed. For example, with the access control device 102 operating in the first mode, a technician may program the access control device 102 by manually entering information into the input/output device 130 of the access control device 102. Thus, in certain situations, the user or technician may utilize a keypad, touch screen, or other input mechanism of the input/output device 130 of the access control device 102. According to other embodiments, when in the first mode, manual programming of the access control device 102 may include the user to technician manually entering information, such as, for example, codes on the mobile electronic device 120, and that information being communicated from the mobile electronic device 120 by the access control device 102 that is being programmed.

According to the illustrated embodiment, the access control device 102 may be structured to be programmed using a second mode in which the access control device 102 is an off-line managed device that is managed via use of the mobile electronic device 120. According to such an embodiment, information from the host 122 and/or server 118, as well as information from the access control device 102, may be stored on the mobile electronic device 120. The information stored on the mobile electronic device 120 may have been retrieved and/or received by the mobile electronic device 120 in a variety of different manners. For example, according to certain embodiments, the information may have been communicated to the mobile electronic device 120 from the host 122 and/or the server 118, including, for example, via a WAN/LAN connection. Further, when the access control device 102 is an off-line managed device, the mobile electronic device 120 may communicate the stored information from the host 122 and/or server 118 to the access control device 102, as well as information from other access control devices 102, in a variety of manners other than through a WI-FI connection. For example, according to certain embodiments, when the access control device 102 is in the second mode, information may be communicated to the access control device 102, and/or between the access control device 102 and the mobile electronic device 120, through the use of a wireless protocol(s) that may, when compared to WI-FI connections, utilize less electrical power. Accordingly, use of a wireless protocol other than WI-FI, such as, for example, BLE, may at least assist in conserving the energy consumed from a battery of a battery-operated access control device 102. Further, according to certain embodiments, when in the second mode, the mobile electronic device 120 may communicate with more than one access control devices 102 using a wireless protocol(s) other than WI-FI.

A third mode for programming the access control device 102 may, like the second mode, be an off-line mode. However, with the third mode, the access control device 102 can be programmed via a WI-FI connection with the host 122 and/or the server 118. For example, according to certain embodiments, the host 122 may, via the gateway 124, communicate to/with the access control device 102 over a WI-FI connection. Further, such connections between the access control device 102 and the host 122 and/or server may be periodic. For example, such communications may be a pre-scheduled occurrence, or may be triggered by the occurrence of a particular event or command. By being periodic, programming or otherwise programming the access control device 102 via the third mode may at least attempt to minimize the energy consumed during the transfer of information and/or the associated communication(s) and/or programming. For example, according to certain embodiments, the access control device 102 may wake-up on a periodic schedule to download updated information from the host 122 and/or the server 118, including information relating to authorization of credentials and/or users to operate components of the security management system 100, among other information. Additionally, according to certain embodiments, use of the third mode for programming the access control device 102 may be initiated by an event, such as, for example, the access control device 102 receiving a command from the host 122 and/or server 118. Alternatively, such a command may be received by the mobile electronic device 120 from the host 122 and/or server 118, and communicated from the mobile electronic device 120 to the access control device 102. Further, the event may be a situation or occurrence at one or more of the access control devices 102 of the security management system 100, such as, for example, a credential being detected by a reader device 108, among other events.

According to certain embodiments, a fourth mode used in programming the access control device 102 may be an online real-time mode in which the gateway 124 can communicate information from the host 122 and/or server 118 directly to the access control device 102, and vice versa, via one of a plurality of available wireless protocols. According to such a mode, the host 122 and/or the server 118 may provide information, such as, for example, firmware or an access control database, among other information, that the gateway 124 communicates to the access control device 102. Further, the access control device 102 may communicate status updates and other information to the gateway 124 in real-time. Further, as previously discussed, according to certain embodiments, communications between the access control device 102 and the gateway 124 may include the selection of a wireless protocol from a plurality of available wireless protocols. For example, as previously discussed, according to certain embodiments, the gateway 124 and the access control devices 102 may be able to communicate with WI-FI and BLE. According to such an embodiment, the WI-FI connection, and associated larger bandwidth, may be utilized for communications involving relatively large amount or size of information, such as, for example, firmware updates, and a BLE connection may, be utilized for communications of involving relatively same amounts or sizes of data, such as, for example, the access control device 102 communicating status updates.

According to certain embodiments, a fifth mode used in programming the access control device 102 may be an off-line real-time mode in which the mobile electronic device 120 may retrieve or receive, in real-time, information from the host 122 and/or the server 118. The mobile electronic device 120 may then communicate the received information to the access control device 102. Thus, according to such a mode, the mobile electronic device 120 may act as the network access point. For example, according to certain embodiments, the mobile electronic device 120 may pull or otherwise retrieve information in real-time from the host 122 and/or server 118, and communicated the pulled or retrieved information to the access control device 102.

Figure 3:
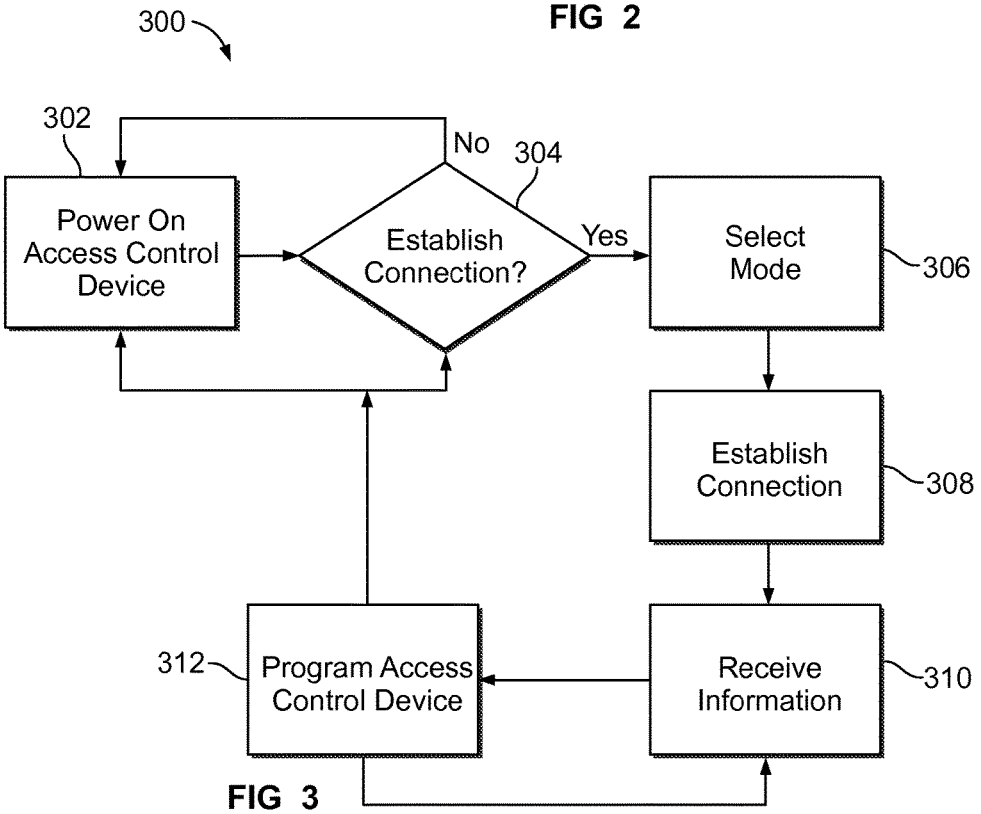
FIG. 3 illustrates a flow diagram of an exemplary procedure for configuring an access control device to communicate in at least one of a plurality of communication modes.

FIG. 3 illustrates a schematic flow diagram of an exemplary process 300 for configuring an access control device 102. The operations illustrated for all of the processes in the present application are understood to be examples only, and operations may be combined or divided, and added or removed, as well as re-ordered in whole or in part, unless explicitly stated to the contrary.

At operation 302, the access control device 102 may, if not already, be powered on. At operation 304, a determination maybe made that a connection is to be made between the access control device 102 and one or more devices of the security management system 100, such as, for example, a connection between the access control device and the gateway 124, the server 118, the mobile electronic device 120, the host 122, and/or another access control device 102. For example, according to certain embodiments, the determination may be the occurrence of a particular event and/or the arrival of a predetermined time at which the access control device 102 is to connect, either directly or indirectly, with another component of the security management system 100. The determination to make a connection with the access control device 102 may also be made by a component of the security management system 100 other than, or in addition to, the access control device 102. For example, the server 118, host 122, and/or the mobile electronic device 120 may determine that those devices, among others, of the security management system 100 have information that is to be received or retrieved by the access control device 102. Thus, in such situations, those devices 118, 120, 122 may determine that a direct or indirect connection is to be established with the access control device 102 that will facilitate the transfer of information to, or from, the access control device 102.

At operation 306, the mode that is to be utilized in programming the access control device 102 may be selected. The selection of the mode for programming the access control device 102 may be based on a variety of different criteria, including, for example, the device(s) that will be connected to the access control device 102, whether the connection of those devices to the access control device 102 is direct or indirect, the available communication protocols, the type, size and/or amount of information being communicate, the electrical energy or power that may (or may not) be consumed in the communication(s) and/or programming, whether the communication is to be (or is not to be) a real-time communication, and/or the time of the communication, among other considerations. Further, the selection of the mode that is to be used in programming the access control device 102 may be made by one or more devices of the security management system 100, including, but not limited to, the server 118, host 122, gateway 124, mobile electronic device 120, and/or the access control device 102.

At operation 308, a connection may be established with the access control device 102 and one or more other components of the security management system 100. At operation 310, the access control device 102 retrieves and/or receives information for programming using one of the following, and previously discussed, modes: a manually programmed device; an off-line managed device via mobile device; a wireless off-line device via Wi-Fi; a wireless real-time device via gateway; and/or an off-line real-time device via mobile device. For example, at operation 310, the access control device 102 receives or retrieves the configuration information according to one of the above modes selected from operation 306 and configures itself with the information. At operation 312, the access control device 102 may utilized the information received to retrieved from the other devices from operation 310, such as, for example apply and/or execute updated access information and/or firmware, among other information. Further, in at least certain instances, following operation 312, the operation 300 may return to operation 304, wherein the access control device 102 and/or other devices of the security management system 100 may await for the occurrence of a determination or event that may facilitate the connection of the access control device 102 with the same or other devices of the security management system 100. Additionally, in at least certain situations, following operation 312, the operation 300 may proceed back to operation 310, wherein the access control device 102 may receive more configuration information, which may, or may not, occur in a mode that is the same or different with the mode selected from the prior operation 306.

It is contemplated that the various aspects, features, computing devices, processes, and operations from the various embodiments may be used in any of the other embodiments unless expressly stated to the contrary.

The various aspects of the processes in the present application may be implemented in instructions or operating logic 132 as operations by software, hardware, artificial intelligence, fuzzy logic, or any combination thereof, or at least partially performed by a user or operator. In certain embodiments, operations represent software elements as a computer program encoded on a computer readable medium, wherein the access control device 102 performs the described operations when executing the computer program.

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

The invention claimed is:

1. An access control device for controlling the displacement of an entryway device, the access control device comprising:

a plurality of wireless transceivers;

a memory for storing instructions, at least a portion of the instructions relating to the displacement of the entryway device; and a processing device coupled to the memory, wherein the processing device selects from at least the following modes for indirect communication with a server of a security management system: first off-line mode and a second off-line mode;

wherein, in the first off-line mode, the access control device (i) establishes a first wireless connection with a gateway device at a pre-scheduled time and (ii) communicates with the server via the gateway device over the first wireless connection established between the access control device and the gateway device and a WAN/LAN connection established between the gateway device and the server; and wherein, in the second off-line mode, the access control device communicates with the server via a mobile device over a second wireless connection established between the mobile device and the access control device and a third wireless connection established between the mobile device and the server.

2. The access control device of claim 1, wherein the access control device communicates over the first wireless connection via a first wireless transceiver of the plurality of wireless transceivers, and wherein the access control device communicates over the second wireless connection via a second wireless transceiver of the plurality of wireless transceivers.

3. The access control device of claim 2, wherein the first wireless transceiver is one of a WI-FI transceiver and a Bluetooth transceiver, and wherein the second wireless transceiver is the other of the WI-FI transceiver and the Bluetooth transceiver.

4. The access control device of claim 1, wherein the processing device wakes at least one of the plurality of wireless transceivers to establish the first wireless connection with the gateway device at the pre-scheduled time.

5. The access control device of claim 1, wherein, in the first off-line mode, the access control device further establishes the first wireless connection in response to receiving a command from the server to establish the first wireless connection.

6. The access control device of claim 5, wherein the access control device communicates over the first wireless connection via a first wireless transceiver of the plurality of wireless transceivers, and wherein the access control device receives the command from the server via a second wireless transceiver of the plurality of wireless transceivers.

7. The access control device of claim 6, wherein the first wireless transceiver is a WI-FI transceiver, and wherein the second wireless transceiver is a Bluetooth transceiver.

8. The access control device of claim 1, wherein the processing device selects from at least the first off-line mode and the second off-line mode based on at least an amount of information to be transmitted between the server and the access control device.

9. The access control device of claim 1, wherein, in the first off-line mode, the access control device further establishes the first wireless connection at a time other than the pre-scheduled time in response to satisfaction of an alternative criterion.

10. The access control device of claim 9, wherein the alternative criterion relates to receiving a command to connect to the server in the first off-line mode.

11. The access control device of claim 1, wherein the access control device communicates over the first wireless connection via a first wireless transceiver of the plurality of wireless transceivers, and wherein the access control device communicates over the second wireless connection via the first wireless transceiver.

12. An access control device, comprising:

a credential reading interface structured to read at least one type of credential;

a plurality of wireless transceivers;

a processor; and a memory comprising a plurality of instructions stored thereon that, in response to execution by the processor, causes the access control device to select from at least the following modes for indirect communication with a server of a security management system: a first off-line mode and a second off-line mode;

wherein, in the first off-line mode, the access control device (i) establishes a first wireless connection with a gateway device at a pre-scheduled time and (ii) communicates with the server via the gateway device over the first wireless connection established between the access control device and the gateway device and an additional connection established between the gateway device and the server; and wherein, in the second off-line mode, the access control device communicates with the server via a mobile device over a second wireless connection established between the mobile device and the access control device and a third wireless connection established between the mobile device and the server.

13. The access control device of claim 12, wherein the additional connection comprises a WAN/LAN connection.

14. The access control device of claim 12, wherein the access control device communicates over the first wireless connection via a first wireless transceiver of the plurality of wireless transceivers, and wherein the access control device communicates over the second wireless connection via a second wireless transceiver of the plurality of wireless transceivers.

15. The access control device of claim 14, wherein the first wireless transceiver comprises a WI-FI transceiver and the second wireless transceiver comprises a Bluetooth transceiver.

16. The access control device of claim 12, wherein the plurality of wireless transceivers includes a first wireless transceiver and a second wireless transceiver, the first wireless transceiver being structured to receive wireless communications via a first wireless protocol, the second wireless transceiver being structured to receive wireless communications via a second wireless protocol, the first wireless protocol being different than the second wireless protocol.

17. The access control device of claim 12, wherein the processing device selects from at least the first off-line mode and the second off-line mode for receipt of a firmware update for the access control device from the server; and wherein the processing device further updates firmware of the access control device based on the received firmware update.

18. The access control device of claim 12, wherein, in the first off-line mode, the access control device further establishes the first wireless connection at a time other than the pre-scheduled time in response to satisfaction of an alternative criterion.

19. The access control device of claim 18, wherein the alternative criterion relates to receiving a command to connect to the server in the first off-line mode.

20. The access control device of claim 19, wherein the access control device communicates over the first wireless connection via a first wireless transceiver of the plurality of wireless transceivers, and wherein the access control device receives the command to connect to the server via a second wireless transceiver of the plurality of wireless transceivers.

21. The access control device of claim 20, wherein the first wireless transceiver comprises a WI-FI transceiver, and wherein the second wireless transceiver comprises a Bluetooth transceiver.

* * * * *